US011118858B1

(12) United States Patent
Harrison

(10) Patent No.: US 11,118,858 B1
(45) Date of Patent: Sep. 14, 2021

(54) SPRING-PISTON AIR GUN WITH RELIABLE COCKED INDICATOR

(71) Applicant: Joshua Charles Harrison, Huntington Beach, CA (US)

(72) Inventor: Joshua Charles Harrison, Huntington Beach, CA (US)

( * ) Notice: Subject to any disclaimer, the term of this patent is extended or adjusted under 35 U.S.C. 154(b) by 0 days.

(21) Appl. No.: 16/996,777

(22) Filed: Aug. 18, 2020

(51) Int. Cl.
*F41B 11/643* (2013.01)
*F41B 11/647* (2013.01)

(52) U.S. Cl.
CPC ..... *F41B 11/643* (2013.01); *F41B 11/647* (2013.01)

(58) Field of Classification Search
CPC ..... F41B 11/643; F41B 11/646; F41B 11/647; F41B 11/648
USPC ..... 124/66, 67, 68
See application file for complete search history.

(56) References Cited

U.S. PATENT DOCUMENTS 1,373,451 A 4/1921 Roe
2,572,176 A 10/1951 Mihalyi
3,924,599 A * 12/1975 Hammond ..... F41B 11/648 124/67
4,165,730 A * 8/1979 Jaedicke ..... F41B 11/642 124/67
4,367,723 A 1/1983 Resuggan
4,771,758 A * 9/1988 Taylor ..... F41B 11/73 124/68
4,844,046 A * 7/1989 Straub ..... F41B 11/647 124/80
4,883,042 A 11/1989 Wackrow
5,193,517 A 3/1993 Taylor et al.
5,205,271 A 4/1993 Casas Salva
5,570,676 A * 11/1996 Gore ..... F41B 11/642 124/56
5,613,482 A * 3/1997 Thai ..... F41B 7/003 124/16
6,352,070 B1 3/2002 Mendoza-Orozco
9,121,654 B2 9/2015 Vera et al.
10,386,154 B2 8/2019 Kras et al.
2010/0059033 A1 3/2010 Gore
(Continued)

OTHER PUBLICATIONS

Robert D. Beeman, Safeties on Airguns?, What is the value of airgun safeties?, Loaded chamber indicators for airguns—and other such notions, Airgun Cocking Indicators, downloaded from https://www.beemans.net/Safety%20%20Devices.htm, 10 pages.
(Continued)

*Primary Examiner* — Bret Hayes
(74) *Attorney, Agent, or Firm* — Barcelo, Harrison & Walker LLP

(57) ABSTRACT

An air gun includes a gun barrel through which a bore passes from a breech end to a muzzle end, a piston, and a spring housed within a main housing. The spring biases the piston forward towards the gun barrel. An air compression chamber is defined by a cylindrical interior surface and a forward face of the piston. A cocking mechanism enables a user to forcibly retract the piston rearward from the gun barrel against the spring bias to a cocked position. The main housing includes a rearward cavity that accepts the rearward retraction of at least a portion of the piston, which portion may include a coating of paint. A first viewing port into the rearward cavity may have a translucent cover and visually indicates a state of rearward retraction of the piston.

18 Claims, 9 Drawing Sheets

(56) References Cited

U.S. PATENT DOCUMENTS

| | | | | |
|---|---|---|---|---|
| 2012/0216786 | A1* | 8/2012 | Hadley | F41B 11/646 124/66 |
| 2014/0165983 | A1* | 6/2014 | Busse | F41B 11/643 124/66 |
| 2014/0373417 | A1 | 12/2014 | Vera et al. | |
| 2015/0107567 | A1 | 4/2015 | Vera et al. | |
| 2018/0031349 | A1* | 2/2018 | Malheiros | F41B 11/648 |
| 2018/0180376 | A1* | 6/2018 | Lamboy | F41B 11/647 |
| 2018/0252492 | A1 | 9/2018 | Spreadbury et al. | |

OTHER PUBLICATIONS

Relum LG15V parts diagram, downloaded from https://www.gunspares.co.uk/products/24481/Super-Tornado-LG15V/ on Aug. 12, 2020, T.W. Chambers Gunmakers, 1 page.

Stoeger Airguns, How Airguns Work, downloaded from https://usa.stoegerairguns.com/how-airguns-work, 9 pages.

Target-Master.nl, Parts Drawing Crosman Phantom 1000 CS1K77, downloaded from https://www.target-master.nl/, 1 page.

* cited by examiner

SPRING-PISTON AIR GUN WITH RELIABLE COCKED INDICATOR

BACKGROUND

Many modern spring-piston air guns can fire a pellet at high-enough velocities to cause serious injury or death to humans.

Firing a spring-piston air gun without any pellet loaded, also known as "dry firing," may be harmful to its mechanical components due to insufficient resistance to piston travel (and consequently higher piston acceleration and terminal momentum). Therefore, unloading the pellet using a bore rod may not practically allow the shooter to uncock the spring-piston air gun without regard to range safety.

Once a contemporary spring-piston air gun is loaded and cocked, often the only practical way to uncock it is to fire it in a safe direction, if a safe direction is available. If a user cannot, or opts not to fire the air gun immediately, then the air gun may be temporarily set aside in a cocked condition. That can create an unsafe situation if other potential users of the air gun cannot visually discern that the air gun is in the cocked condition.

Contemporary auto-safety mechanisms, which engage the trigger safety automatically when the air gun is cocked, do not avoid the potentially unsafe situation described above, because the trigger safety must be able to be manually disengaged before shooting. Hence, an initial user may manually disengage the safety, even if the safety had been automatically engaged by cocking the air rifle, in anticipation of taking a shot. If that initial user then elects to not fire that shot, the appearance of a disengaged safety thereafter may incorrectly signal to follow-on users that the air gun has not yet been cocked.

Hence, there is a need in the art for a spring-piston air gun with a cocking indicator having an outward visual appearance that always reliably corresponds to the actual cocking condition of the gun, and that a user cannot alter from the actual cocking condition of the gun. Such a cocking indicator would unambiguously improve safety for all users of spring-piston air guns, at all training levels.

DESCRIPTION OF EXAMPLE EMBODIMENTS

Figure 1A:
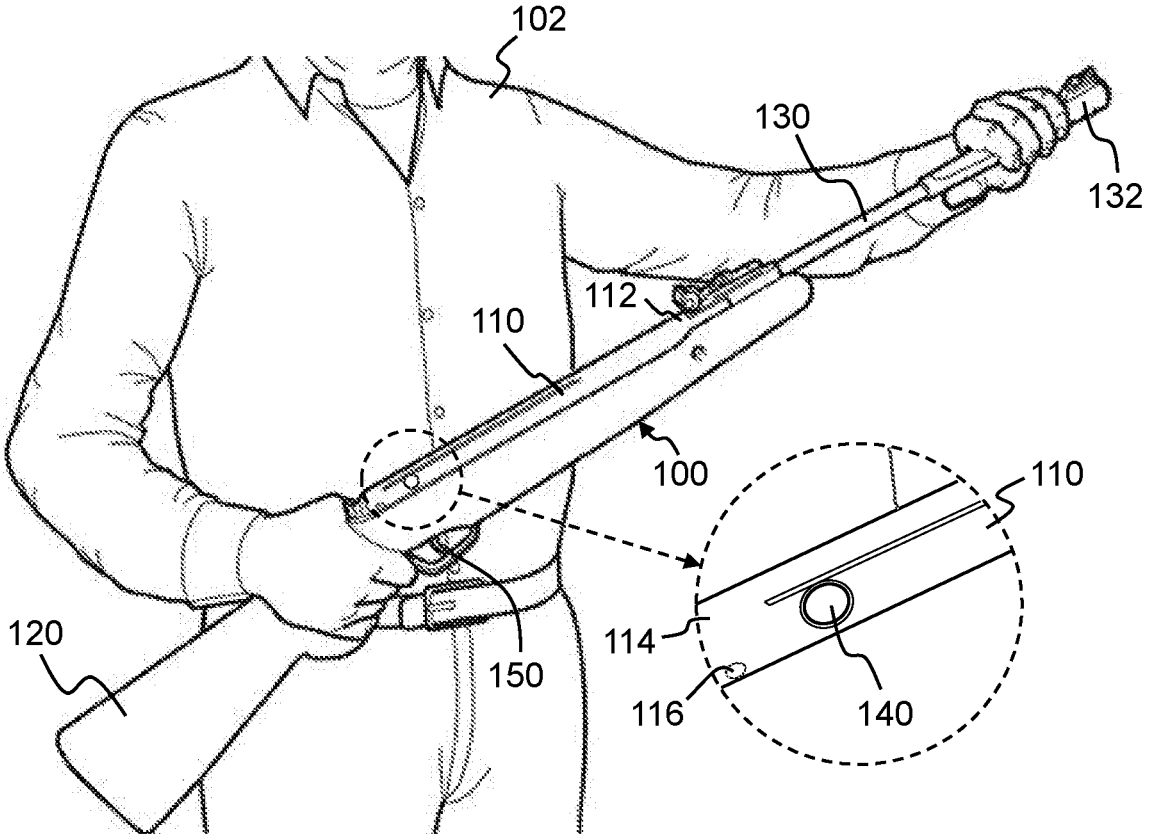
FIG. 1A depicts a break-barrel spring-piston air rifle according to an embodiment of the present invention, before cocking by a user.
Figure 1B:
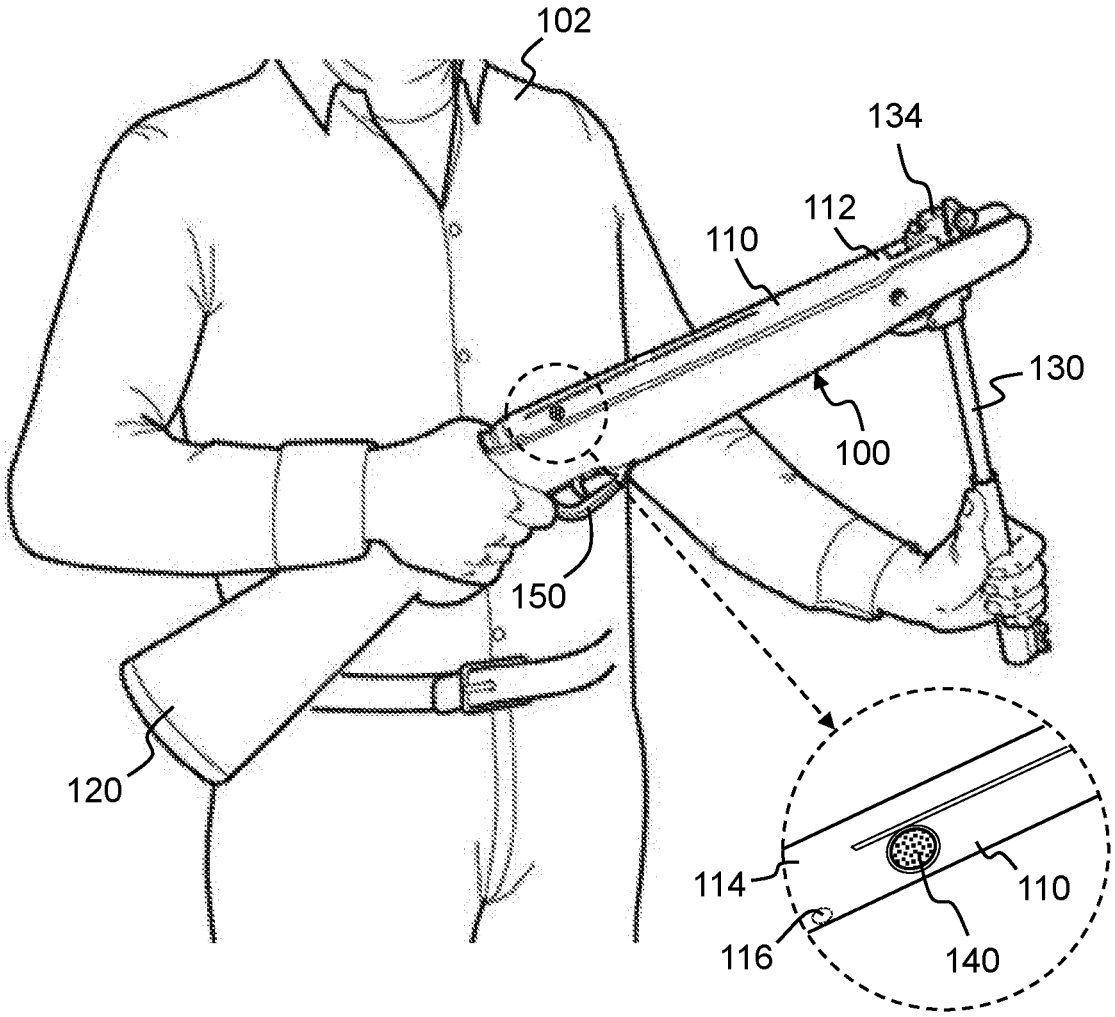
FIG. 1B depicts the spring-piston air rifle of FIG. 1A, after cocking by the user.

FIG. 1A depicts a break-barrel spring-piston air rifle 100 according to an embodiment of the present invention, before cocking by a user 102. FIG. 1B depicts the spring-piston air rifle 100, after cocking by the user 102. The air rifle 100 includes a stock 120 and a gun barrel 130, that is pivotably attached to a main housing 110 adjacent its forward end 112. The forward end 112 of the main housing 110 can selectively supply a pulse of compressed air to a breech end 134 of the gun barrel 130, when the air rifle 100 is cocked and fired. Cocking is accomplished by the user 102 grasping the barrel 130 near its muzzle end 132, and forcibly angularly displacing the barrel 130 as shown in FIG. 1B. Firing may then be prompted by pulling the trigger 150.

In the embodiment of FIGS. 1A and 1B, the break-barrel spring-piston air rifle 100 includes a viewing port 140 into a cavity of the main housing 110 near its rearward end 114. Note that a fixed-end pin 116 is also shown to be disposed near the rearward end 114 of the main housing 110. The viewing port 140 comprises an exterior opening (depicted as inner circle) into the main housing 110, and a translucent cover over the opening (depicted as outer circle) overlapping the main housing 110. In this context, "translucent" means that light discernable to the user 102 can be reflected through the cover. For example, a transparent cover is a type of translucent cover.

In certain embodiments, the opening of the viewing port 140 may be a circular hole drilled through a wall of the main housing 110, and the translucent cover may have a larger diameter than the hole diameter so as to have an outer periphery that radially overlaps a flush or counter-sunk outer surface of the main housing 110 around the hole. In such embodiments, the outer periphery of the translucent cover may be adhered to the outer surface of the main housing 110 using an epoxy or cyanoacrylate glue in the annular overlapping region. As will be understood from the detailed description of the internal components of the following example embodiments of air guns according to the present invention, the viewing port 140 may be located relative to the internal components of the air gun so that the translucent cover does not need to withstand large air pressure differentials, and so that air leaks through the translucent cover would be unimportant and would not affect the operation or power of the air rifle 100.

In the embodiment of FIGS. 1A and 1B, the viewing port 140 has a different outward visual appearance when the air rifle 100 is in a cocked condition, versus when the air rifle 100 is in an uncocked condition. As will be understood from the detailed description of the internal components of the following example embodiments of air guns according to the present invention, the viewing port 140 may be located relative to the internal components of the air gun so that the outward appearance of the viewing port 140 will reliably correspond to whether an internal piston is in a rearward cocked position, or not. Since the position of the piston in a spring-piston air rifle unfailingly corresponds to its state of stored potential energy for firing, the user 102 can refer to the viewing port 140 as a dependable cocking indicator for the air rifle 100 regardless of the proper or negligent operation by any prior user, or the prior user's habits or level of firearms training.

Figure 2:
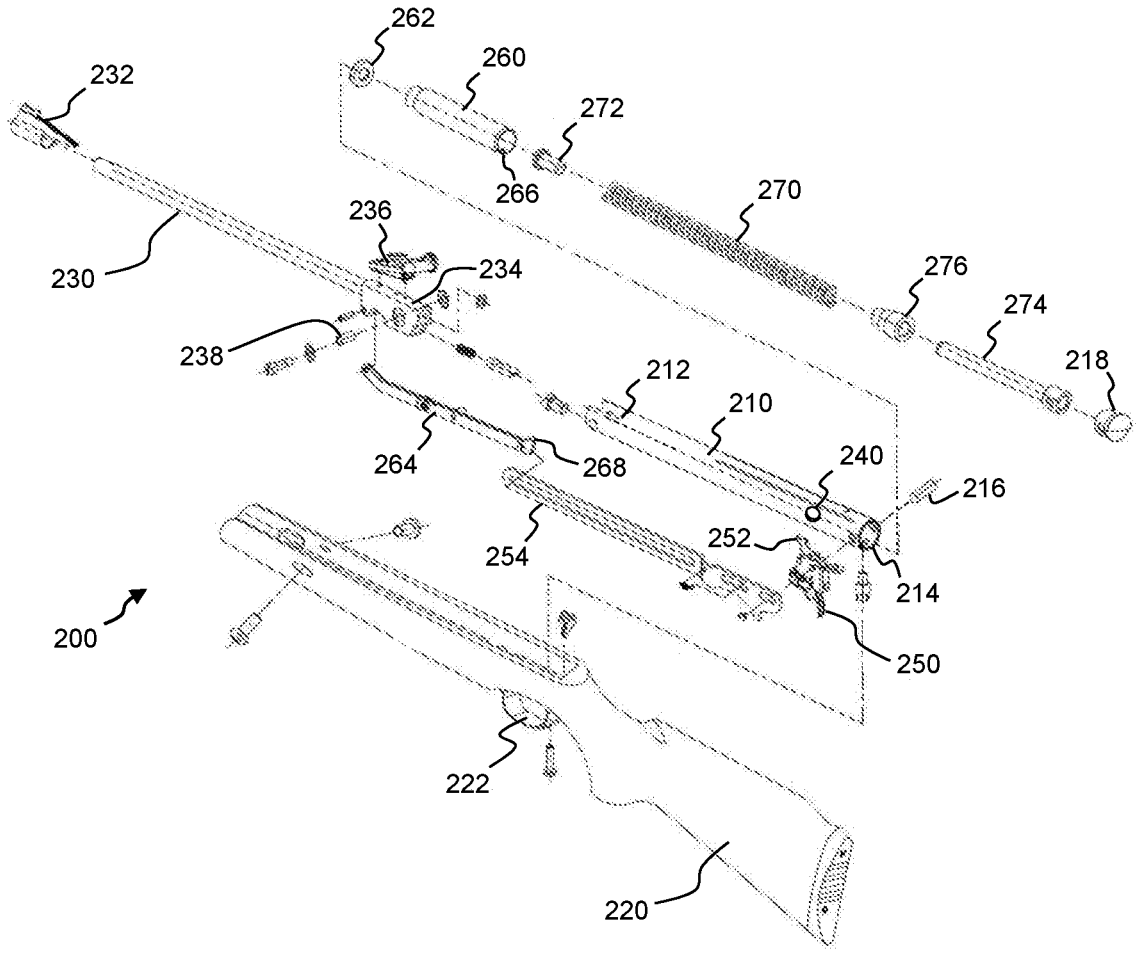
FIG. 2 is an exploded perspective view of a break-barrel spring-piston air rifle according to an embodiment of the present invention.

FIG. 2 is an exploded perspective view of a break-barrel spring-piston air rifle 200, according to an embodiment of the present invention. The air rifle 200 has a gun barrel 230 through which a bore passes from a breech end 234 (where a rear sight 236 is attached) to a muzzle end (where a front sight 232 is attached). The air rifle 200 includes a piston 260 and a spring 270 housed within a main housing 210, and the piston 260 has a forward face and a peripheral outer surface.

In the embodiment of FIG. 2, the spring 270 is a conventional coil spring having open ends. However, in certain alternative embodiments, the spring 270 may be replaced with a conventional pressurized gas spring. Potential energy may be stored in the coil spring 270 by increasing strain from a neutral position, with spring force increasing with increased spring deflection according to Hooke's Law. Alternatively, if the spring 270 is replaced with a conventional gas spring, sometimes known as a gas strut, then potential energy may be stored in the conventional pressurized gas spring in the form of increased pressure in a sealed charge of already-pressurized nitrogen gas. In that case, the apparent spring force may be proportional to increasing nitrogen gas pressure as the gas strut is mechanically compressed.

In the embodiment of FIG. 2, the spring 270, when it is compressed for assembly, biases the piston 260 forward towards the gun barrel 230. The compression and expansion of the coil spring 270 may be steadied by a moving spring guide 272, sleeve 276, and a fixed spring guide 274. Each of the spring guides 272, 274 partially protrudes longitudinally into an open end of the coil spring 270. The rearward end of the piston 260 optionally may be hollow to capture the moving end of the spring 270, and thereby receive a force from the spring 270 that urges the piston forward towards the gun barrel 230 with more consistent alignment. In the embodiment of FIG. 2, the moving spring guide 272 is also received within the hollow rearward end of the piston 260.

In the embodiment of FIG. 2, the air rifle 200 includes an air compression chamber within the main housing 210 that is in fluid communication with the breech end 234 of the gun barrel 230, to supply a charge of compressed air through the barrel 230 at the moment of firing. In the embodiment of FIG. 2, the air compression chamber is defined by the forward face of the piston 260 and a cylindrical interior surface of the main housing 210, so that the air compression chamber is integral with the main housing 210. In an alternative embodiment, the interior surface of the air compression chamber may be an interior surface of a distinct air compression chamber component that slides within the main housing 210 (e.g. with the piston 260 nested inside of the sliding air compression chamber component). In either context, the term "cylindrical" does not necessarily require a right circular cylinder having a circular cross-section. Rather, the cross section of the cylinder may be non-circular so long as the air compression requisite for firing can be created by forward movement of the piston 260 under force from the spring 270 (at the moment of firing).

In the embodiment of FIG. 2, the piston 260 includes a seal subcomponent 262, which is annular in shape because the mating cylindrical interior surface of the main housing 210 is optionally circular in cross-section. Such a shape may be preferable for simplicity of design and assembly, and uniform wear of a piston seal parts. However, if the cylindrical interior surface of the main housing 210 is of circular cross-section, then the piston 260 and seal 262 may be designed to have a matching cross-sectional shape so that air could still be compressed by the piston within the air compression chamber. In either case, the peripheral outer surface of the piston 260 (including that of its annular seal 262) faces the interior surface of the air compression chamber of the main housing 210. The portion of the peripheral outer surface that corresponds to the annular seal subcomponent 262 is in sliding contact with the mating interior surface of the air compression chamber of the main housing 210.

In the embodiment of FIG. 2, a barrel pivot pin 238 pivotably attaches the breech end 234 of the gun barrel 230 to a forward end 212 of the main housing 210. The air rifle 200 includes a cocking linkage 264 that is pivotably attached to the gun barrel 230 (at a location offset from the barrel pivot), and the cocking linkage 264 includes a nose 268 that engages with a nose-receiving feature 266 of the piston 260 during cocking. The translation of the cocking linkage 264 may be guided by the stock 220 of the air rifle 200. The cocking linkage 264, and its interaction with the nose-receiving feature 266 of the piston 260, enables a user to forcibly retract the piston 260 rearward away from the gun barrel 230 against the spring bias to a cocked position. In the embodiment of FIG. 2, a sear 252 releasably holds the piston 260 in the rearward cocked position against the urging of the compressed spring 270, depending on the position of the trigger 250 within the trigger well 222. A cocking safety linkage 254 may be included to temporarily prevent the trigger 250 from releasing the sear 252 during cocking, before the barrel 230 is returned to a closed firing position.

In the embodiment of FIG. 2, the break-barrel spring-piston air rifle 200 includes a viewing port 240 into a rearward cavity of the main housing 210 forward of its rearward end 214. Note that a fixed-end pin 216 and an end cap 218 are also disposed near the rearward end 214 of the main housing 210, in the embodiment of FIG. 2. The rearward cavity of the main housing 210 accepts the rearward retraction of the piston 260 during cocking. The viewing port 240 comprises an exterior opening into the rearward cavity of the main housing 210.

In the embodiment of FIG. 2, the opening of the viewing port 240 is located to view a portion of the outer surface of the piston 260 when the piston is in the cocked position. The opening of the viewing port 240 is preferably covered by a translucent cover to reduce dust and debris from entering the rearward cavity of the main housing 210. In the embodiment of FIG. 2, the opening of the viewport 240 is depicted as round, which may be the easiest shape for fabrication of the opening, and may facilitate a lens design in embodiments where a transparent lens is used as the translucent cover (e.g. to achieve enhanced optical properties for viewing components internal to the rearward cavity of the main housing 210). However, in other embodiments the opening of the viewport 240 may alternatively be of a non-circular shape, for example, a longitudinally-oriented rectangular slot may be used to expose a longitudinal position of a rearward edge of the piston 260 when the air rifle 200 is cocked, and may also facilitate the use of a flat translucent cover rather than a translucent cover optionally having convexity that matches that of the exterior surface of the main housing 210.

Because the rearward cavity of the main housing 210 is not pressurized by forward motion of the piston 260, the translucent cover does not need to withstand large air pressure differentials. Therefore, any air leaks through the translucent cover are unimportant in this embodiment, and would not affect the operation or power of the air rifle 200. In certain embodiments, the translucent cover of the viewing port 240 may be fabricated from a transparent amorphous plastic, a glass fiber reinforced amorphous plastic, a translucent semi-crystalline polymer, a glass-fiber-reinforced semi-crystalline polymer, clear glass, tinted glass, or frosted glass.

In the embodiment of FIG. 2, all or a portion of the piston 260 may advantageously be reflective (e.g. a polished region, plating, or a paint coating). In this context, "reflective" means only that enough light can be reflected that the surface is visible through the viewing port 240 when the piston 260 is in the cocked position. In many embodiments, a coating of common white or red paint may be adequately reflective, i.e. may reflect sufficient light (e.g., in the red spectrum) for the retracted-rearward position of the piston 260 to be discernable through the translucent cover of the viewing port 240.

In certain embodiments, the piston 260 may be a piston assembly that includes subcomponents other than the seal subcomponent 262, for example some piston assemblies include a rearward plunger rod subcomponent to transmit a retracting force to the piston from the rear during cocking. In such embodiments, the rearward cavity of the main housing may accept the entire piston in the cocked position, or may accept only the rearward protrusion of the piston's plunger rod in the cocked position. Hence, in certain embodiments it is not important that the primary compression subcomponent of the piston be visible through the viewing port; all that is important is that the air gun user can reliably visually discern through the viewing port, whether the piston is in the rearward position, for example by viewing a narrower plunger that moves with the piston, a sliding pressure chamber that slides with the rearward retraction of the piston, or a spring component (e.g. a spring guide). In such embodiments, it may not be important how reflective or visible is the outer surface of the primary compression subcomponent of the piston.

Figure 3:
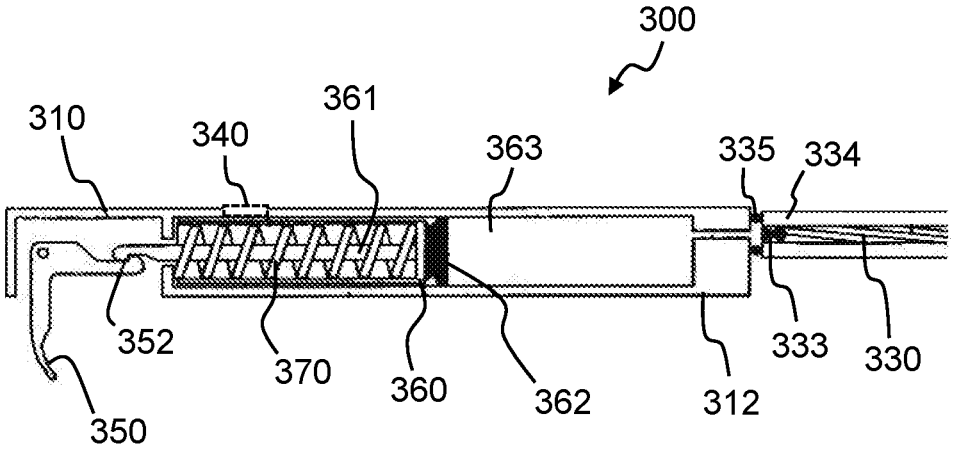
FIG. 3 is schematic diagram of a subset of components of a spring-piston air gun in the cocked condition, according to an embodiment of the present invention.

FIG. 3 is schematic diagram of a subset of components of a spring-piston air gun 300 in the cocked condition, according to an embodiment of the present invention. The air gun 300 includes a piston 360 and a spring 370 housed within a main housing 310. In the embodiment of FIG. 3, the spring 370 is a coil spring having open ends, which biases the piston 360 forward towards a gun barrel 330. In the embodiment of FIG. 3, the bore of the gun barrel 330 is shown to include rifling, and may preferably have a diameter that corresponds to a popular caliber for air gun pellets (e.g., .177 caliber, .22 caliber, or .30 caliber). The rearward end of the piston 360 is hollow to capture at least the moving end of the spring 370.

In the embodiment of FIG. 3, the piston 360 includes a rearward plunger rod subcomponent 361 that can apply a force to retract the piston 360 against the forward urging of the compressed spring 370. The rearward plunger rod subcomponent 361 moves with the rest of the piston 360. In the embodiment of FIG. 3, a sear 352 releasably holds the piston 360 in the rearward cocked position against the forward urging of the compressed spring 370, depending on the position of the trigger 350.

The air gun 300 includes an air compression chamber 363 within a main housing 310 that is in fluid communication with the breech end 334 of a gun barrel 330, to supply a charge of compressed air to propel a pellet 333 through a gun barrel 330 at the moment of firing. The charge of compressed air requisite for firing can be created by forward movement of the piston 360 under force from the spring 370 at the moment of firing. A breech seal 335 (e.g. a rubber O-ring) helps contain the charge of compressed air received from the compression chamber 363 behind the forward end 312 of the main housing 310.

In the embodiment of FIG. 3, the piston 360 includes a seal subcomponent 362 that mates with the interior surface of the air compression chamber 363 so that air can be compressed by forward motion of the piston 360 within the air compression chamber 363. The peripheral outer surface of the piston 360 (including that of its seal subcomponent 362) faces the interior surface of the air compression chamber 363. The portion of the peripheral outer surface that corresponds to the annular seal subcomponent 362 is in sliding contact with the mating interior surface of the air compression chamber 363.

In the embodiment of FIG. 3, the air gun 300 includes a viewing port 340 into a rearward cavity of the main housing 310. The rearward cavity of the main housing 310 accepts the rearward retraction of the piston 360 in the cocked condition, as shown in FIG. 3. The viewing port 340 comprises an exterior opening into the rearward cavity of the main housing 310, located to view a portion of the outer surface of the piston 360 when the piston is in the cocked position as shown. The opening of the viewing port 340 may be covered by a translucent cover (shown in dashed lines, optionally embedded in the main housing 310), to reduce dust and debris from entering the rearward cavity of the main housing 310. In this context, "translucent" means that light discernable to the user can be reflected through the cover, so that a transparent cover or lens is considered herein to be a type of translucent cover.

Because the rearward cavity of the main housing 310 is not pressurized by forward motion of the piston, the translucent cover does not need to withstand large air pressure differentials. Therefore, any air leaks through the translucent cover are unimportant in this embodiment, and would not affect the operation or power of the air gun 300. Indeed, in certain preferred embodiments of the present invention, the translucent cover of the viewing port 340 may optionally include a pin hole or small aperture for positioning the translucent cover during assembly and warranty rework, the pin hole or slot allowing limited air flow through the viewing port 340 while limiting the size of any debris that may pass therethrough.

In certain embodiments, the translucent cover of the viewing port 340 may be fabricated from a transparent amorphous plastic, a glass fiber reinforced amorphous plastic, a translucent semi-crystalline polymer, a glass-fiber-reinforced semi-crystalline polymer, clear glass, tinted glass, or frosted glass. For example, the plastic material of the translucent cover may comprise polycarbonate, polyethylene, polypropylene, polymethylmethacrylate, cellulose acetate butyrate, glycol modified polyethylene terephthalate plastic, or another commercially-available translucent material.

In the embodiment of FIG. 3, all or a portion of the piston 360 may advantageously be reflective (e.g. have a coating) that can reflect enough light to be visible through the viewing port 340 when the piston 360 is in the cocked position (as shown). A reflective surface does not necessarily require a mirror-like finish, or chrome plating, or a metallic paint. A coating of white paint is adequately reflective in many embodiments. In some embodiments, the material of the piston may be naturally adequately reflective without surface coating or modification, or its surface may be polished to be more reflective everywhere or in a region. In many embodiments a coating of common red paint may be adequately reflective (i.e. may reflect sufficient light in the red spectrum to be visible through the viewing port 340). In certain embodiments, a brightly reflective red paint may be preferred so that it can be easily visible through the viewing port and can imply danger—i.e. the that air gun is cocked—to air gun users who are not the original purchaser and so may not have read warnings and instructions from the air gun manufacturer.

Figure 4:
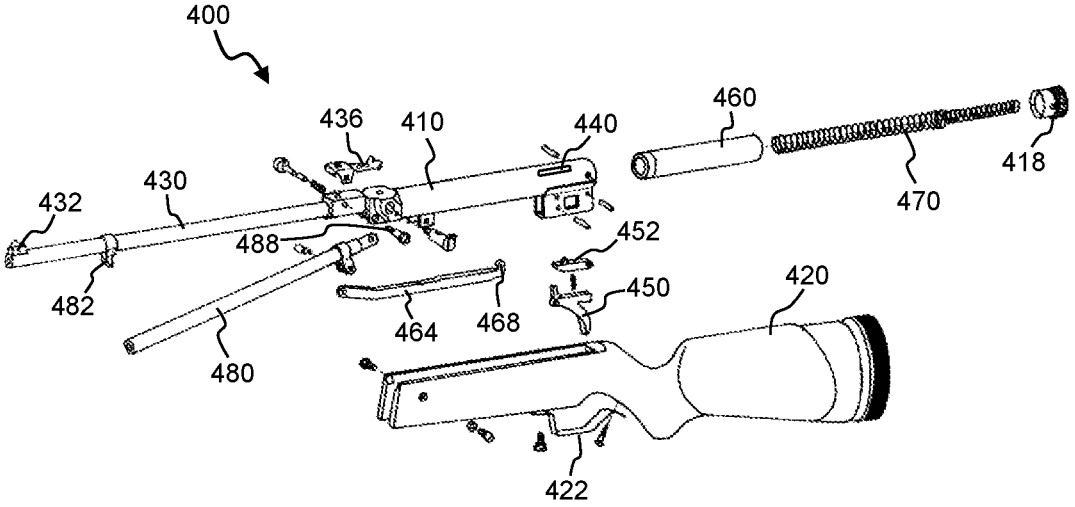
FIG. 4 is an exploded perspective view of a spring-piston air rifle having a cocking lever attached under the gun barrel, according to an embodiment of the present invention.

FIG. 4 is an exploded perspective view of a spring-piston air rifle 400 having a cocking lever 480 attached under the gun barrel 430, according to an embodiment of the present invention. During cocking, the cocking lever 480 is angularly displaced away from a stowed position (where it was held adjacent to the gun barrel 430 by latch 482). The gun barrel 430 includes a bore that passes from a breech end (where a rear sight 436 is attached) to a muzzle end (where a front sight 432 is attached). The air rifle 400 includes a piston 460 and a spring 470 housed within a main housing 410, and the piston 460 is shown to have a forward face and a peripheral outer surface.

In the embodiment of FIG. 4, the spring 470 is a conventional coil spring, however, in certain alternative embodiments, the spring 470 may be replaced with a conventional pressurized gas spring. The spring 470, when it is compressed for assembly, biases the piston 260 forward towards the gun barrel 430. The rearward end of the piston 460 optionally may be hollow to capture the moving end of the spring 470, and thereby receive a force from the spring 470 that urges the piston forward towards the gun barrel 430 with more consistent alignment.

In the embodiment of FIG. 4, the air rifle 400 includes an air compression chamber within the main housing 410 that is in fluid communication with the gun barrel 430, to supply a charge of compressed air through the barrel 430 at the moment of firing. In the embodiment of FIG. 4, the air compression chamber is defined by the forward face of the piston 460 and a cylindrical interior surface of the main housing 410. The peripheral outer surface of the piston 460 faces and can be in sliding contact with the interior surface of the air compression chamber of the main housing 410.

In the embodiment of FIG. 4, a cocking lever pivot pin 488 pivotably attaches the cocking lever 480 to the breech end of the gun barrel 430. The air rifle 400 includes a cocking linkage 464 that is pivotably attached to the cocking lever 488 (at a location offset from the cocking lever pivot pin 488), and the cocking linkage 464 includes a nose 468 that engages with a nose-receiving feature on the underside of the piston 460 (not shown) during cocking. Most of the cocking linkage 464 may be obscured from view by the stock 420 of the air rifle 400 after assembly. The cocking linkage 464, and its interaction with the nose-receiving feature of the piston 460, enables a user to forcibly retract the piston 460 rearward away from the gun barrel 430 against the spring bias to a cocked position. In the embodiment of FIG. 4, a sear 452 releasably holds the piston 460 in the rearward cocked position against the urging of the compressed spring 470, depending on the position of the trigger 450 within the trigger well 422.

In the embodiment of FIG. 4, the spring-piston air rifle 400 includes a viewing port 440 into a rearward cavity of the main housing 410. Note that an end cap 418 is disposed at the rearward end of the rearward cavity of the main housing 410. The rearward cavity of the main housing 410 accepts the rearward retraction of the piston 460 during cocking. The viewing port 440 comprises an exterior opening into the rearward cavity of the main housing 410. In the embodiment of FIG. 4, the opening of the viewing port 440 is a longitudinally-oriented rectangular slot that is located to expose a longitudinal position of a rearward edge of the piston 460 and/or a portion of the outer surface of the piston 460, when the piston 460 is in the rearward cocked position.

The opening of the viewing port 440 is preferably covered by a translucent cover to reduce dust and debris from entering the rearward cavity of the main housing 410. The cover of the viewing port 440 is considered to be translucent if it allows sufficient light to be reflected through itself that the user can readily discern through the viewing port 440 whether the piston 460 is or is not in the rearward cocked position. In certain embodiments, the translucent cover of the viewing port 440 may be fabricated from a transparent amorphous plastic, a glass fiber reinforced amorphous plastic, a translucent semi-crystalline polymer, a glass-fiber-reinforced semi-crystalline polymer, clear glass, tinted glass, or frosted glass.

In the embodiment of FIG. 4, the narrow rectangular shape of the viewing port 440 may facilitate the optional use of a flat translucent cover rather than a translucent cover having convexity that matches that of the exterior surface of the main housing 410. In certain alternative embodiments, the opening of the viewing port 440 may be another shape (e.g., round). Because the rearward cavity of the main housing 410 is not pressurized by the forward movement of the piston 460, the translucent cover does not need to withstand large air pressure differentials. Therefore, any air leaks through the translucent cover are unimportant in this embodiment, and would not affect the operation or power of the air rifle 400.

In the embodiment of FIG. 4, all or a portion of the piston 460 may advantageously be sufficiently reflective that that its presence becomes practically discernable through the viewing port 440 when the piston 460 is in the cocked position. In some embodiments, the material of the piston may be naturally adequately reflective without plating, surface coating, or polishing. In many embodiments a coating of common red paint may be adequately reflective (i.e. may reflect sufficient light in the red spectrum to be visible through the viewing port 440) and can imply danger—i.e. the that air gun is cocked—to air gun users who are not the original purchaser and so may not have read warnings and instructions from the air gun manufacturer.

Figure 5A:
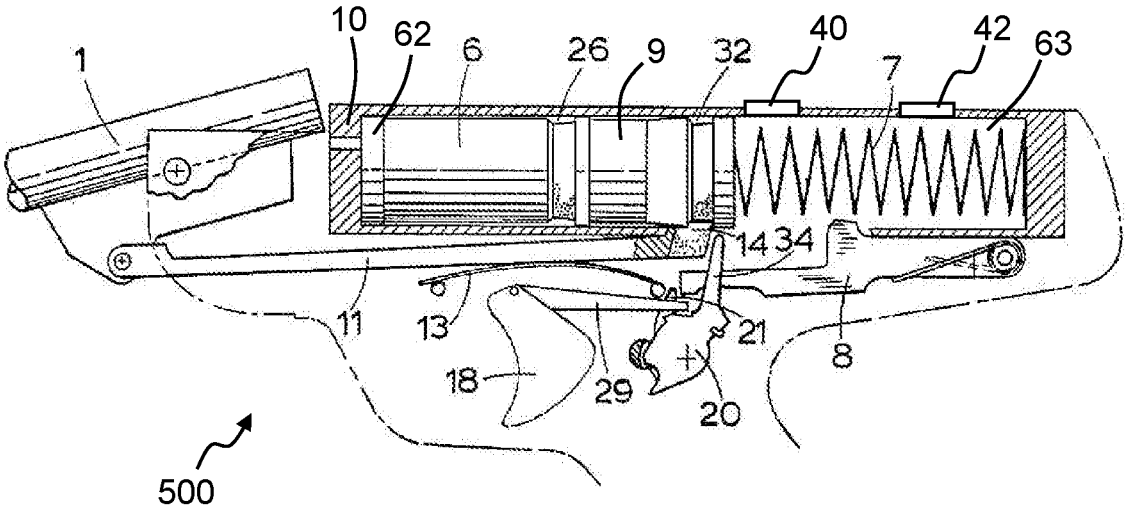
FIG. 5A is a cut-away side view of a break-barrel spring-piston air pistol having two staged cocking, in the uncocked condition, according to an embodiment of the present invention.
Figure 5B:
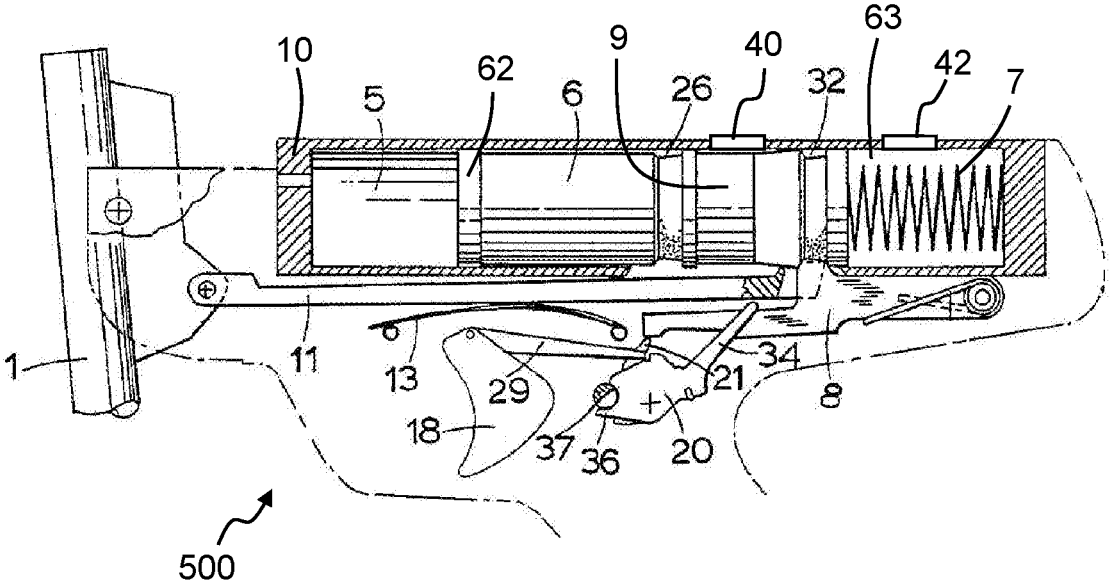
FIG. 5B is a cut-away side view of the spring-piston air pistol of FIG. 5A, in the semi-cocked condition.
Figure 5C:
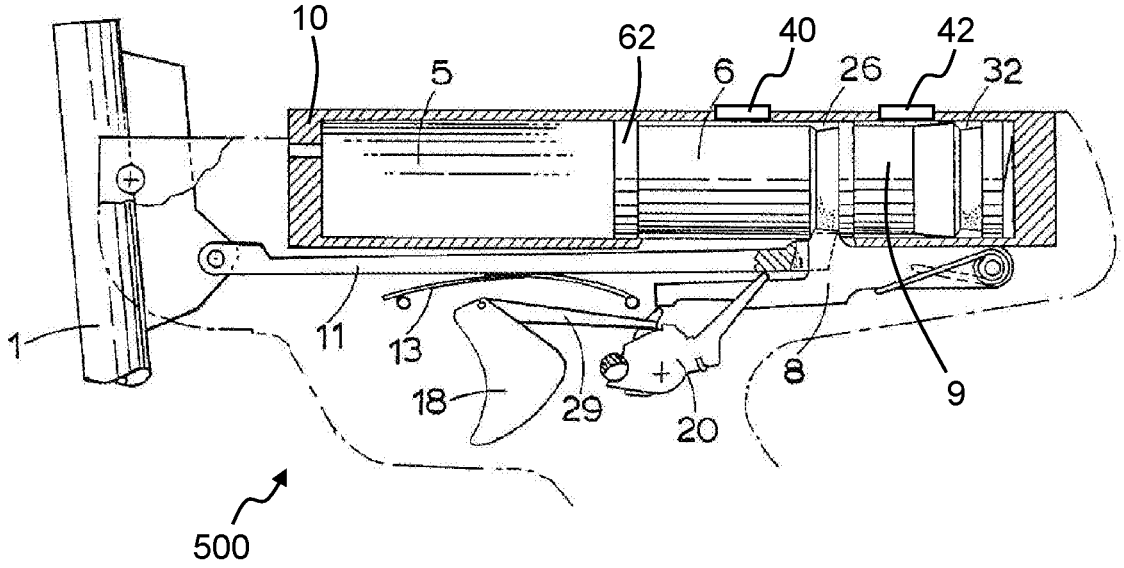
FIG. 5C is a cut-away side view of the spring-piston air pistol of FIG. 5A, in the cocked condition.

FIGS. 5A, 5B, and 5C are a cut-away side views of a break-barrel spring-piston air pistol 500 having two staged cocking, in the uncocked condition, the semi-cocked condition, and the cocked condition, respectively, according to an embodiment of the present invention. The air pistol 500 includes a piston 6 and a coil spring 7 housed within a main housing 10. The coil spring 7 biases the piston 6 forward towards a pivotably-mounted gun barrel 1.

In the embodiment of FIGS. 5A-5C, the air pistol 500 includes an air compression chamber 5 within the main housing 10 that is in fluid communication with the gun barrel 1, to supply a charge of compressed air through the gun barrel 1 at the moment of firing. The air compression chamber 5 is defined by the forward face of the piston 6 and a cylindrical interior surface of the main housing 10. The piston 6 includes a seal subcomponent 62, and the peripheral outer surface of the piston 6 (including that of its seal 62) faces the interior surface of the air compression chamber 5 of the main housing 10. The portion of the peripheral outer surface that corresponds to the seal subcomponent 62 is in sliding contact with the mating interior surface of the air compression chamber 5 of the main housing 10.

In the embodiment of FIGS. 5A-C, the piston 6 has several subcomponents in addition to the seal subcomponent 62. For example, the piston 6 includes a forward circumferential groove 26, and a rearward recess formed by a circumferential groove 32 separated by an intermediate piston span 9. In the cocked condition of FIG. 5C, the piston 6 is retained in a rearward position by an upper sear 8 releasable by a trigger mechanism that includes the trigger 18. Now referring to FIGS. 5A-C, when the trigger 18 is pressed, a trigger bar 29 is disengaged from a detent in a hammer 20, allowing the hammer 20 to move pivotally anticlockwise (in the depicted views). A projection on the opposite face of the hammer 20 (not shown) strikes an edge of a lower sear 21 and dislodges it from the upper sear 8. The force through the piston 6 by action of the coil spring 7 then drops the upper sear 8 from one of the two circumferential grooves 26, 32 in the piston 6. That allows the piston 6 to move forward in its firing stroke, that is to say to the left as viewed in FIGS. 5A-C, compressing air in the air compression chamber 5 of the main housing 10. The air passes through a port at the forward end of the main housing 10 to expel a pellet from the air pistol 500 through a bore in the gun barrel 1.

FIG. 5A shows the relative position of the components after firing and at the start of the cocking movement. The cocking linkage 11 has been moved rearwards far enough to allow a bow spring 13 to urge a nose 14 of the cocking linkage 11 upwards towards the rearward circumferential groove 32 of the piston 6. Further downward pivoting of the barrel 1 moves the cocking linkage 11 further rearwards, engaging the nose 14 of the cocking linkage with the rearward circumferential groove 32 of the piston 6, taking the piston 6 rearwards, and also engages an arm 34 of a hammer 20 and moves it in a clockwise direction. This brings the lower sear 21 against the upper sear 8 which prevents it from moving with the hammer 20. Clockwise movement of the hammer 20 continues until a lower arm 36 of the hammer 20 comes into contact with the lower lip of a groove 37 in a rotatable safety. The hammer 20 is held cocked and a trigger bar 29 drops in front of a detent in the hammer 20, ready to re-engage the hammer 20 when the safety is disengaged.

After one full cocking pivot of the gun barrel 1, the internal components of the air pistol 500 arrive to semi-cocked condition shown in FIG. 5B. The air pistol 500 could be fired from this semi-cocked condition (at lower pellet velocity) with the spring 7 only partly compressed. If, however, the coil spring 7 is to be fully compressed, then the gun barrel 1 must be exercised through another cocking pivot motion by the user (i.e. two-stage cocking).

In the second cocking motion, the nose 14 of the cocking linkage 11 enters the forward groove 26 of the piston 6. Swinging the barrel downwards and rearwards the second time moves the piston 6 further rearwards to the cocked position with the coil spring 7 fully compressed. When user pressure on the gun barrel 1 is released, the urging of the coil spring 7 moves the piston 6 forwards, and the upper sear 8 engages within the forward groove 26 to releasably hold the piston 6 in the cocked condition. When the air pistol 500 is fired after double cocking action, from the cocked condition with the coil spring 7 fully compressed between the piston 6 and a rear wall of the main housing 10 (as shown in FIG. 5C), a higher pellet velocity can be obtained than when it is fired from the semi-cocked condition shown in FIG. 5B (with the coil spring 7 only partly compressed).

In the embodiment of FIGS. 5A-C, the break-barrel spring-piston air pistol 500 includes viewing ports 40 and 42 into the rearward cavity 63 of the main housing 10. The rearward cavity 63 of the main housing 10 accepts the rearward retraction of the piston 6 during cocking. Each of the viewing ports 40, 42 comprises an exterior opening into the rearward cavity 63 of the main housing 10, which are located to achieve specific conditional functions.

Specifically, in the embodiment of FIGS. 5A-C, the opening of the viewing port 40 is located to not view the piston when the air pistol 500 is in the uncocked condition. The opening of the viewing port 40 is located to view the intermediate piston span 9 of the piston 6 (between the circumferential grooves 26 and 32) when the air pistol 500 is in the semi-cocked condition. The opening of the viewing port 40 is also located to view the piston 6 forward of the forward circumferential groove 26, when the air pistol 500 is in the cocked condition.

By contrast, the opening of the viewing port 42 is located to view the intermediate piston span 9 of the piston 6 (between the circumferential grooves 26 and 32) when the piston 6 is in the fully-rearward cocked position, but to not view the piston in the uncocked and semi-cocked positions. Hence, in the embodiment of FIGS. 5A-C, the external visual indications of the viewing ports 40, 42 can give a reliable indication of the two-stage cocking condition to the user of the air pistol.

In the embodiment of FIGS. 5A-C, the openings of the viewing ports 40 and 42 are preferably covered by translucent covers to reduce dust and debris from entering the rearward cavity 63 of the main housing 10. The covers of the viewing ports 40, 42 are considered to be translucent if each allows sufficient light to be reflected through itself that the user can readily discern whether an outer surface of the piston 6 is facing the viewing port or not. Because the rearward cavity 63 of the main housing 10 is not pressurized by the forward movement of the piston 6, the translucent covers of the viewing ports 40, 42 do not need to withstand large air pressure differentials. Therefore, any air leaks through the translucent covers are unimportant in this embodiment, and would not affect the operation or power of the air pistol 500.

In the embodiment of FIGS. 5A-C, all or a portion of the piston 6 may advantageously be sufficiently reflective that that its presence becomes practically discernable through one or more of the viewing ports 40, 42 when the piston 6 is in the semi-cocked or cocked position (as described above). In some embodiments, the material of the piston may be naturally adequately reflective without plating, surface coating, or polishing. In many embodiments a coating of common red paint may be adequately reflective (i.e. may reflect sufficient light in the red spectrum to be visible through one or more of the viewing ports 40, 42) and can imply danger—i.e. the that air gun is semi-cocked or cocked—to air gun users who are not the original purchaser and so may not have read warnings and instructions from the air gun manufacturer.

In one of many possible example color combinations, the intermediate piston span 9 may be coated with white or yellow paint that is visible through the viewing port 40 when the piston 6 is in the semi-cocked position, and visible through the viewing port 42 when the piston 6 is in the fully-rearward cocked position. The piston forward of the forward circumferential groove 26 optionally may be coated with red paint that is visible through the viewing port 40 when the piston 6 is in the fully-rearward cocked position. In this way, the external appearance of the viewing ports 40, 42 can clearly and reliably indicate the two-stage cocking condition to the user of the air pistol.

Figure 6A:
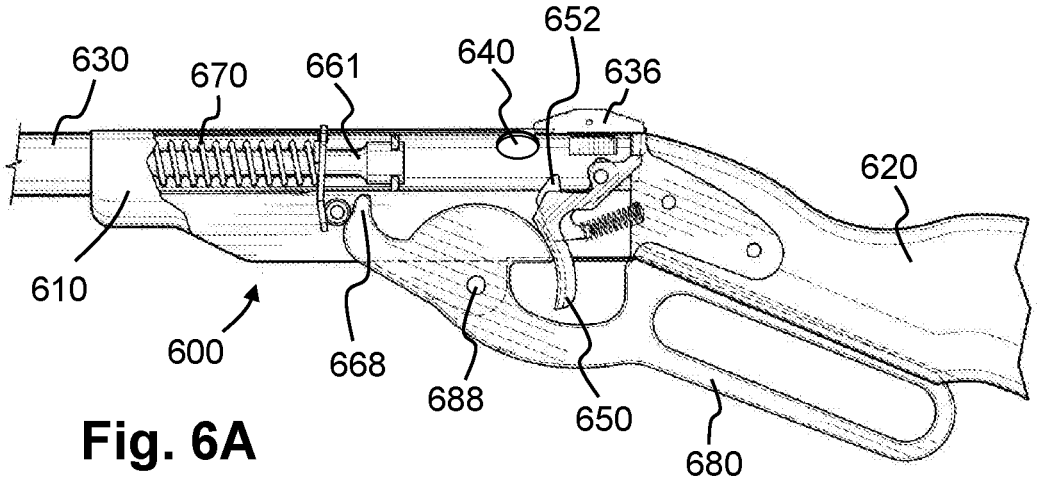
FIG. 6A is a cut-away side view of a lever-action spring-piston air rifle in the uncocked condition, according to an embodiment of the present invention.
Figure 6B:
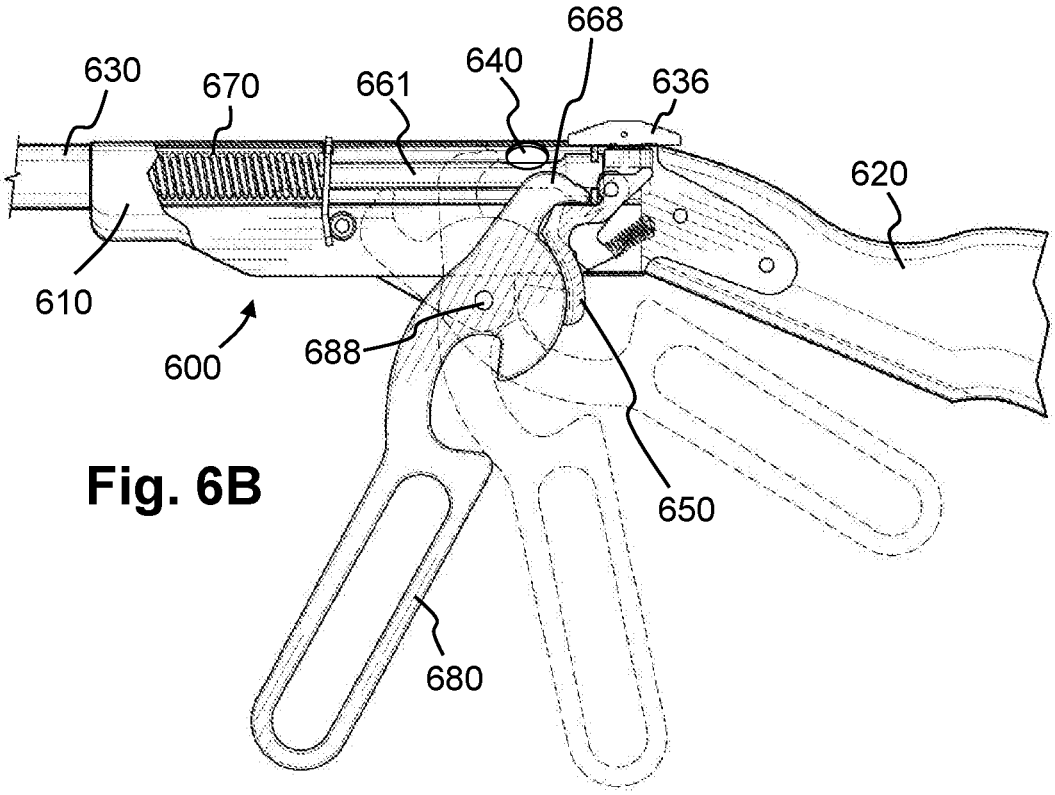
FIG. 6B is a cut-away side view depicting cocking of the lever-action spring-piston air rifle of FIG. 6A.
Figure 6C:
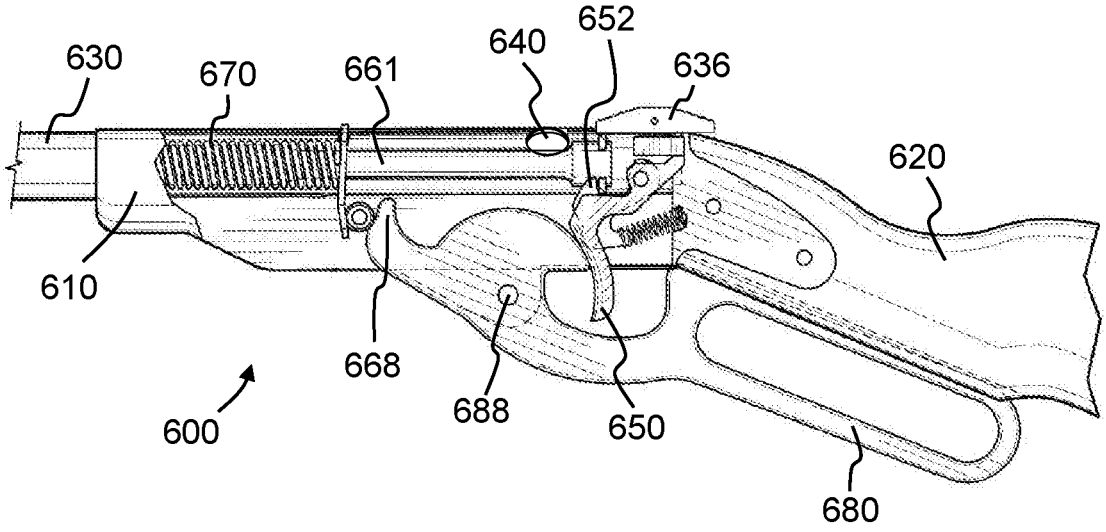
FIG. 6C is a cut-away side view of the lever-action spring-piston air rifle of FIG. 6A, in the cocked condition.

FIG. 6A is a cut-away side view of a lever-action spring-piston air rifle 600 in the uncocked condition, according to an embodiment of the present invention. FIG. 6B depicts cocking of the lever-action spring-piston air rifle 600, and FIG. 6C shows the air rifle 600 in the cocked condition. Now referring to FIGS. 6A-C, the air rifle 600 includes a gun barrel 630, a stock 620, and a main housing 610 that houses a coil spring 670 and a piston that includes a plunger rod subcomponent 661. The coil spring 670 biases the piston (and its plunger rod subcomponent 661) forward towards the gun barrel 630. A cocking lever 680 is pivotably attached by cocking pivot pin 688 to the air rifle 600. The cocking lever 680 lever has a nose 668 that engages with a plunger rod subcomponent 661 of the piston during cocking.

As shown in FIG. 6B, the rotation of the cocking lever 680, and the interaction of its nose 668 with the plunger rod subcomponent 661 of the piston, enables a user to forcibly retract the piston rearward away from the gun barrel 630 against the spring bias to a cocked position. The rearward motion of the plunger rod subcomponent 661 of the piston ultimately contacts and automatically engages a sliding safety 636, by moving it backwards to interfere with anti-clockwise rotation of a trigger 650. As shown in FIG. 6C, a sear 652 releasably holds the plunger rod subcomponent 661 of the piston in the rearward cocked position against the urging of the compressed spring 670, depending on the position of the trigger 650. The trigger 650 can be depressed to drop the sear 652 and release the plunger rod subcomponent 661 of the piston, if the sliding safety 636 is first pushed forward to no longer interfere with anti-clockwise rotation of the trigger 650.

In the embodiment of FIG. 6, the lever-action spring-piston air rifle 600 includes a viewing port 640 into a rearward cavity of the main housing 610. The rearward cavity of the main housing 610 accepts the rearward retraction of the plunger rod subcomponent 661 of the piston during cocking. In the embodiment of FIG. 6, the opening of the viewing port 640 is located to view an outer surface of the plunger rod subcomponent 661 of the piston, when in the rearward cocked position.

The opening of the viewing port 640 is preferably covered by a translucent cover to reduce dust and debris from entering the rearward cavity of the main housing 610. The cover of the viewing port 640 is considered to be translucent if it allows sufficient light to be reflected through itself that the user can readily discern through the viewing port 640 whether the plunger rod subcomponent 661 of the piston is or is not in the rearward cocked position. In certain embodiments, the translucent cover of the viewing port 640 may be fabricated from a transparent amorphous plastic, a glass fiber reinforced amorphous plastic, a translucent semi-crystalline polymer, a glass-fiber-reinforced semi-crystalline polymer, clear glass, tinted glass, or frosted glass.

Because the rearward cavity of the main housing 610 is not pressurized by the forward movement of the piston, the translucent cover does not need to withstand large air pressure differentials. Therefore, any air leaks through the translucent cover are unimportant in this embodiment, and would not affect the operation or power of the air rifle 600.

In the embodiment of FIG. 6, all or a portion of the plunger rod subcomponent 661 of the piston may advantageously be sufficiently reflective that that its presence becomes practically discernable through the viewing port 640 when the piston is in the rearward cocked position. In some embodiments, the material of the plunger rod subcomponent 661 of the piston may be naturally adequately reflective without plating, surface coating, or polishing. In many embodiments a coating of common red paint may be adequately reflective (i.e. may reflect sufficient light in the red spectrum to be visible through the viewing port 640) and can imply danger—i.e. the that air gun is cocked—to air gun users who are not the original purchaser and so may not have read warnings and instructions from the air gun manufacturer.

In the foregoing specification, the invention is described with reference to specific exemplary embodiments, but those skilled in the art will recognize that the invention is not limited to those. It is contemplated that various features and aspects of the invention may be used individually or jointly and possibly in a different environment or application. The specification and drawings are, accordingly, to be regarded as illustrative and exemplary rather than restrictive. For example, the word "preferably," and the phrase "preferably but not necessarily," are used synonymously herein to consistently include the meaning of "not necessarily" or optionally. "Comprising," "including," and "having," are intended to be open-ended terms. The phrase "consisting of" is intended to be closed-ended so as to exclude additional elements that do not pertain to those elements that are recited, but not to foreclose the possibility of sub-parts or sub-components of the elements that are recited.

What is claimed:

1. An air gun, comprising:

a gun barrel through which a bore passes from a breech end to a muzzle end;

a piston and a spring housed within a main housing, the piston having a forward face and a peripheral outer surface, the spring biasing the piston forward towards the gun barrel;

an air compression chamber in fluid communication with the breech end of the gun barrel, the air compression chamber defined by a cylindrical interior surface and the forward face of the piston, the peripheral outer surface of the piston including a mating surface that is in sliding contact with the interior surface of the air compression chamber;

a cocking mechanism that enables a user to forcibly retract the piston rearward from an uncocked position against the spring bias to a cocked position, the main housing including a rearward cavity that accepts the rearward retraction of at least a portion of the piston; and a first viewing port into the rearward cavity of the main housing;

the peripheral outer surface of the piston being visible through the first viewing port when the piston is in the cocked position but not when the piston is in the uncocked position.

2. The air gun of claim 1 further comprising a trigger, and a sear that can releasably hold the piston in the cocked position depending on the position of the trigger.

3. The air gun of claim 1 wherein the air gun is a pistol, and the bore of the gun barrel is rifled and has a bore diameter corresponding to .22 caliber pellets.

4. The air gun of claim 1 wherein the air gun is a rifle and the bore of the gun barrel has a bore diameter corresponding to .177 caliber pellets.

5. The air gun of claim 1 wherein the spring is a conventional pressurized gas spring.

6. The air gun of claim 1 further comprising a second viewing port into the rearward cavity of the main housing, the second viewing port providing a different view into the rearward cavity of the main housing than the first viewing port.

7. The air gun of claim 1 wherein the cocking mechanism enables the user to forcibly retract the piston rearward from the gun barrel against the spring bias to a semi-cocked position and to the cocked position, and the air gun further comprises a second viewing port that is staggered longitudinally with respect to the first viewing port.

8. The air gun of claim 7 further comprising a first reflective portion of the peripheral outer surface of the piston, the first reflective portion being visible through the second viewing port when the piston is in the semi-cocked position, and the first reflective portion being visible through the first viewing port when the piston is in the cocked position.

9. The air gun of claim 8 further comprising a second reflective portion of the peripheral outer surface of the piston, the second reflective portion being visible through the second viewing port when the piston is in the cocked position.

10. The air gun of claim 9 wherein each of the first and second reflective portions of the piston comprises a coating of paint.

11. An air gun, comprising:

a gun barrel through which a bore passes from a breech end to a muzzle end;

a piston and a spring housed within a main housing, the piston having a forward face and a peripheral outer surface, the spring biasing the piston forward towards the gun barrel;

an air compression chamber in fluid communication with the breech end of the gun barrel, the air compression chamber defined by a cylindrical interior surface and the forward face of the piston, the peripheral outer surface of the piston including a mating surface that is in sliding contact with the interior surface of the air compression chamber;

a cocking mechanism that enables a user to forcibly retract the piston rearward from the gun barrel against the spring bias to a cocked position, the main housing including a rearward cavity that accepts the rearward retraction of at least a portion of the piston;

a first viewing port into the rearward cavity of the main housing, the first viewing port visually indicating a state of rearward retraction of the piston, and a reflective surface on at least one portion of the piston, the reflective surface being visible through the first viewing port when the piston is in the cocked position, wherein the at least one portion of the piston pertains to an outer surface of a rearward plunger rod subcomponent of the piston.

12. An air gun, comprising:

a gun barrel through which a bore passes from a breech end to a muzzle end;

a piston and a spring housed within a main housing, the piston having a forward face and a peripheral outer surface, the spring biasing the piston forward towards the gun barrel;

an air compression chamber in fluid communication with the breech end of the gun barrel, the air compression chamber defined by a cylindrical interior surface and the forward face of the piston, the peripheral outer surface of the piston including a mating surface that is in sliding contact with the interior surface of the air compression chamber;

a cocking mechanism that enables a user to forcibly retract the piston rearward from the gun barrel against the spring bias to a cocked position, the main housing including a rearward cavity that accepts the rearward retraction of at least a portion of the piston;

a first viewing port into the rearward cavity of the main housing, the first viewing port visually indicating a state of rearward retraction of the piston, and a reflective surface on at least one portion of the piston, the reflective surface being visible through the first viewing port when the piston is in the cocked position, wherein the reflective surface comprises a coating of white or colored paint on the at least one portion of the piston.

13. An air gun, comprising:

a gun barrel through which a bore passes from a breech end to a muzzle end;

a piston and a spring housed within a main housing, the piston having a forward face and a peripheral outer surface, the spring biasing the piston forward towards the gun barrel;

an air compression chamber in fluid communication with the breech end of the gun barrel, the air compression chamber defined by a cylindrical interior surface and the forward face of the piston, the peripheral outer surface of the piston including a mating surface that is in sliding contact with the interior surface of the air compression chamber;

a cocking mechanism that enables a user to forcibly retract the piston rearward from the gun barrel against the spring bias to a cocked position, the main housing including a rearward cavity that accepts the rearward retraction of at least a portion of the piston; and a first viewing port into the rearward cavity of the main housing, the first viewing port visually indicating a state of rearward retraction of the piston, wherein the first viewing port comprises an opening into the rearward cavity of the main housing, and a translucent cover over the opening.

14. The air gun of claim 13 wherein the translucent cover of the viewing port comprises a material selected from the group consisting of amorphous plastics, glass fiber reinforced amorphous plastics, semi-crystalline polymers, glass-fiber-reinforced semi-crystalline polymers, clear glass, tinted glass, and frosted glass.

15. The air gun of claim 14 wherein the translucent cover of the viewing port is a transparent lens.

16. An air gun, comprising:

a gun barrel through which a bore passes from a breech end to a muzzle end;

a piston and a spring housed within a main housing, the piston having a forward face and a peripheral outer surface, the spring biasing the piston forward towards the gun barrel;

an air compression chamber in fluid communication with the breech end of the gun barrel, the air compression chamber defined by a cylindrical interior surface and the forward face of the piston, the peripheral outer surface of the piston including a mating surface that is in sliding contact with the interior surface of the air compression chamber;

a cocking mechanism that enables a user to forcibly retract the piston rearward from the gun barrel against the spring bias to a cocked position, the main housing including a rearward cavity that accepts the rearward retraction of at least a portion of the piston; and a first viewing port into the rearward cavity of the main housing, the first viewing port visually indicating a state of rearward retraction of the piston, wherein the gun barrel is pivotably attached to the main housing adjacent the breech end, and the cocking mechanism comprises a linkage having a first end that is pivotably attached to the gun barrel, and a second end that includes a nose that engages with the piston during cocking.

17. An air gun, comprising:

a gun barrel through which a bore passes from a breech end to a muzzle end;

a piston and a spring housed within a main housing, the piston having a forward face and a peripheral outer surface, the spring biasing the piston forward towards the gun barrel;

an air compression chamber in fluid communication with the breech end of the gun barrel, the air compression chamber defined by a cylindrical interior surface and the forward face of the piston, the peripheral outer surface of the piston including a mating surface that is in sliding contact with the interior surface of the air compression chamber;

a cocking mechanism that enables a user to forcibly retract the piston rearward from the gun barrel against the spring bias to a cocked position, the main housing including a rearward cavity that accepts the rearward retraction of at least a portion of the piston; and a first viewing port into the rearward cavity of the main housing, the first viewing port visually indicating a state of rearward retraction of the piston, wherein the cocking mechanism comprises a lever that is pivotably attached to the air gun, and the lever has a nose that engages with a plunger rod of the piston during cocking.

18. An air gun, comprising:

a gun barrel through which a bore passes from a breech end to a muzzle end;

a piston and a spring housed within a main housing, the piston having a forward face and a peripheral outer surface, the spring biasing the piston forward towards the gun barrel;

an air compression chamber in fluid communication with the breech end of the gun barrel, the air compression chamber defined by a cylindrical interior surface and the forward face of the piston, the peripheral outer surface of the piston including a mating surface that is in sliding contact with the interior surface of the air compression chamber;

a cocking mechanism that enables a user to forcibly retract the piston rearward from the gun barrel against the spring bias to a cocked position, the main housing including a rearward cavity that accepts the rearward retraction of at least a portion of the piston; and a first viewing port into the rearward cavity of the main housing, the first viewing port visually indicating a state of rearward retraction of the piston, wherein the cocking mechanism comprises a lever that is pivotably attached to the air gun, and a linkage that has a first end that is pivotably attached to the lever, the linkage having a second end that includes a nose that engages with the piston during cocking.

* * * * *